US007585059B2

(12) United States Patent
Sagara et al.

(10) Patent No.: US 7,585,059 B2
(45) Date of Patent: Sep. 8, 2009

(54) INK JET HEAD AND PRODUCTION METHOD THEREFOR

(75) Inventors: Tomoyuki Sagara, Sakura (JP); Yoshinori Nakajima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 337 days.

(21) Appl. No.: 11/667,811

(22) PCT Filed: Nov. 16, 2005

(86) PCT No.: PCT/JP2005/021054

§ 371 (c)(1),
(2), (4) Date: May 15, 2007

(87) PCT Pub. No.: WO2006/054609

PCT Pub. Date: May 26, 2006

(65) Prior Publication Data

US 2008/0100665 A1 May 1, 2008

(30) Foreign Application Priority Data

Nov. 16, 2004 (JP) ..... 2004-332025

(51) Int. Cl.
*B41J 2/045* (2006.01)

(52) U.S. Cl. ..... 347/68; 347/47; 347/65

(58) Field of Classification Search ..... 347/20, 347/44, 47, 54, 65, 68, 70–72
See application file for complete search history.

(56) References Cited

U.S. PATENT DOCUMENTS 4,611,219 A * 9/1986 Sugitani et al. ..... 347/47
6,820,963 B2 * 11/2004 Stauffer et al. ..... 347/47

FOREIGN PATENT DOCUMENTS

JP 2000-043252 2/2000
JP 2003-039661 2/2003

* cited by examiner

*Primary Examiner*—Juanita D Stephens
(74) *Attorney, Agent, or Firm*—Edwards Angell Palmer & Dodge LLP; David G. Conlin; David A. Tucker

(57) ABSTRACT

An ink jet head is provided which includes: a piezoelectric board having a plurality of elongated channels arranged parallel to each other and isolated from each other by channel walls; and a nozzle plate having a plurality of nozzle holes provided in association with the respective channels, and bonded onto the piezoelectric board with the nozzle holes located at generally longitudinally middle positions of the respective channels; wherein the nozzle plate has trench-like recesses each having a predetermined width and a predetermined depth and extending perpendicularly to the channels as being spaced equidistantly from the nozzle holes longitudinally of the channels; gaps for communication between adjacent channels are defined by the recesses between a surface of the nozzle plate and upper face portions of the channel walls located equidistantly from the nozzle holes; and active areas contributable to ink ejection are defined in each of the channels on opposite sides of the corresponding nozzle hole along the channel. This arrangement prevents deterioration of ejection characteristics attributable to bonding offset of the nozzle plate, and suppresses residual vibration occurring due to pressure waves without complication of the construction of the ink jet head, thereby ensuring stable ejection characteristics even in high speed driving.

7 Claims, 6 Drawing Sheets

INK JET HEAD AND PRODUCTION METHOD THEREFOR

TECHNICAL FIELD

The present invention relates to an ink jet head and a production method therefor and, more specifically, to an ink jet head of a top shooter type having active areas provided on opposite sides of nozzle holes thereof for pressurizing ink.

BACKGROUND ART

Known as a prior art related to the present invention is an ink jet head of a side shooter type, which includes porous members such as of sponge provided as vibration absorbers in junctions between a plurality of ink pressurizing chambers and common ink chambers for prevention of a crosstalk phenomenon which may otherwise occur between the ink pressurizing chambers due to pressure waves after ink ejection (see, for example, Patent Document 1).

Patent Document 1: Japanese Unexamined Patent Publication No. 2000-43252

DISCLOSURE OF THE INVENTION

Problems to be Solved by the Invention

The construction of a typical prior-art ink jet head of a top shooter type will be described with reference to FIG. 9, which is an explanatory diagram schematically illustrating the construction of a prior-art ink jet head unit of the top shooter type.

As shown in FIG. 9, the prior-art ink jet head unit 100 of the top shooter type primarily includes a piezoelectric board 101 polarized along the thickness thereof, and a nozzle plate 109 bonded onto the piezoelectric board 101.

The piezoelectric board 101 includes a plurality of elongated ink chambers 104 formed by dicing, and shallow channel portions 105 provided on end portions of the respective ink chambers 104.

Electrodes 106 and electrode protection films (not shown) for protecting the electrodes 106 are provided on interior surfaces of the ink chambers 104 and the shallow channel portions 105, and the electrodes 106 respectively extend to the shallow channel portions 105 to be connected to terminals of an external board 108 arranged at a pitch corresponding to the pitch of the shallow channel portions 105.

In the ink chambers 104, common ink chambers 107A, 107B extending perpendicularly to the ink chambers 104 for communication between adjacent ink chambers 104 are provided on opposite sides of nozzle holes 110 with respect to the lengths of the ink chambers 104.

That is, the common ink chambers 107A, 107B extend perpendicularly to the plurality of ink chambers 104, and ink is supplied into the ink chambers 104 through the common ink chambers 107A, 107B and ejected from the nozzle holes 110.

When voltages are applied to the electrodes 106 in the respective ink chambers 104 from the external board 108 according to image data, the inner walls of the ink chambers 104 are deformed inward, whereby ink in the ink chambers 104 is pressurized. As a result, the ink is ejected from the nozzle holes 110.

Areas contributable to the ejection of the ink are herein referred to as active areas A.E1, A.E2, which are provided on opposite sides of each of the nozzle holes 110 in the ink jet head unit 100 of the top shooter type.

Such a piezoelectric-type ink jet head unit 100 is capable of controlling the deformation of the piezoelectric body by controlling the voltages for controlling the pressure of the ink and the amount of droplets of the ink to be ejected, thereby permitting easy gradation printing.

Unlike the ink jet head of the side shooter type described in BACKGROUND ART, the ink jet head unit 100 of the top shooter type can be driven at relatively low ejection voltages because the active areas A.E1, A.E2 contributable to the ink ejection are present on the opposite sides of each of the nozzle holes 110. Therefore, the ink jet head unit of the top shooter type is advantageous in terms of heat generation and power consumption.

With the provision of the two active areas A.E1, A.E2, however, the lengths of the active areas A.E1, A.E2 vary among the ink chambers 104, if the nozzle plate 109 is not bonded at a predetermined position.

This is because the lengths of the active areas A.E1, A.E2 are determined by distances between the nozzle hole 110 and the common ink chambers 107A, 107B in the prior-art ink jet head unit 100 of the top shooter type. In other words, the active areas A.E1, A.E2 are determined by the lengths of bonding areas of the nozzle plate 109 bonded to upper face portions of the walls of the ink chambers 104 between the nozzle hole 110 and the common ink chambers 107A, 107B in the prior-art ink jet head unit 100 of the top shooter type.

Therefore, it is essential to bond the nozzle plate 109 to the piezoelectric board 101 so that the nozzle hole 110 is located at a mid-point between the common ink chambers 107A and 107B in each of the ink chambers 104 in the prior-art ink jet head unit 100 of the top shooter type.

If the active areas A.E1, A.E2 differ in length in each of the ink chambers 104, the time required for pressure waves occurring in the ink chamber 104 to reach the nozzle hole 110 differs between the active areas A.E1 and A.E2, resulting in a time lag. This results in variations in ejection characteristics of the ink jet head 100.

Further, if the number of times of the ejection per unit time is increased by increasing a driving frequency for higher speed image formation, residual vibration occurring due to a pressure in the ink chambers 104 may make the subsequent ink ejection unstable.

The residual vibration which is the cause of the unstable ink ejection is a phenomenon such that the pressure waves (vibration) occurring after the ink ejection are mostly reflected on interfaces between the ink chambers 104 and the common ink chambers 107A, 107B back into the ink chambers 104 without attenuation by a water hammer effect, and aversely influences the characteristics of the subsequent ink ejection.

Particularly, where the driving frequency is increased, the subsequent ink ejection occurs before the attenuation of the residual pressure waves, leading to significant variations in ink ejection speed. In a certain case, this may result in extremely unstable ink ejection or inability of ink ejection.

Not only the top shooter type but also the side shooter type suffer from the problem of the unstable ejection due to the residual vibration. The ink jet head described in BACKGROUND ART copes with the crosstalk problem and other problems attributable to the residual vibration by providing the vibration absorbers such as of sponge in the junctions between the common ink chambers and the ink pressurizing chambers to attenuate the pressure waves when the pressure waves pass through the vibration absorbers.

However, the provision of the vibration absorbers for coping with the residual vibration complicates the construction of the ink jet head, and reduces the productivity, thereby increasing production costs.

In view of the foregoing, the present invention is directed to an ink jet head which prevents deterioration of ejection characteristics attributable to bonding offset of the nozzle plate and suppresses the residual vibration occurring due to the pressure waves without complication of the construction thereof, thereby ensuring stable ejection characteristics even in high speed driving.

Means for Solving the Problems

According to the present invention, there is provided an ink jet head, which comprises: a piezoelectric board having a plurality of elongated channels arranged parallel to each other and isolated from each other by channel walls; and a nozzle plate having a plurality of nozzle holes provided in association with the channels, and bonded onto the piezoelectric board with the nozzle holes located at generally longitudinally middle positions of the respective channels; wherein the nozzle plate has trench-like recesses each having a predetermined width and a predetermined depth and extending perpendicularly to the channels as being spaced equidistantly from the nozzle holes longitudinally of the channels; gaps for communication between adjacent channels are defined by the recesses between a surface of the nozzle plate and upper face portions of the channel walls located equidistantly from the nozzle holes; and active areas contributable to ink ejection are defined in each of the channels on opposite sides of the corresponding nozzle hole along the channel.

Effects of the Invention

According to the present invention, the trench-like recesses each having the predetermined width and the predetermined depth are formed in the nozzle plate as extending perpendicularly to the channels and spaced equidistantly from the nozzle holes longitudinally of the channels, and the gaps for the communication between the adjacent channels are defined by the recesses between the surface of the nozzle plate and the upper face portions of the channel walls located equidistantly from the nozzle holes. Further, the active areas contributable to the ink ejection are defined in each of the channels on the opposite sides of the corresponding nozzle hole along the channel. Therefore, the lengths of the active areas as measured longitudinally of the channel are inevitably equal to each other in the channel, thereby preventing the deterioration of the ejection characteristics which may otherwise occur due to bonding offset of the nozzle plate.

According to the present invention, the lengths of the active areas are determined not by the accuracy of the bonding between the piezoelectric board and the nozzle plate but by the positional accuracy of the recesses formed in the nozzle plate. Even if the piezoelectric board and the nozzle plate are not bonded to each other with desired bonding accuracy in a production process, the lengths of the active areas are inevitably equal to each other as long as the positional accuracy of the recesses formed in the nozzle plate falls within a predetermined range. This allows for stable production of a high quality ink jet head.

Further, pressure waves generated by pressurizing ink in the respective channels are mostly attenuated when passing through the gaps which communicate with the adjacent channels. Thus, residual vibration is suppressed, so that the ejection characteristics are stably maintained even in high speed driving.

DESCRIPTION OF THE REFERENCE NUMERALS

Figure 1:
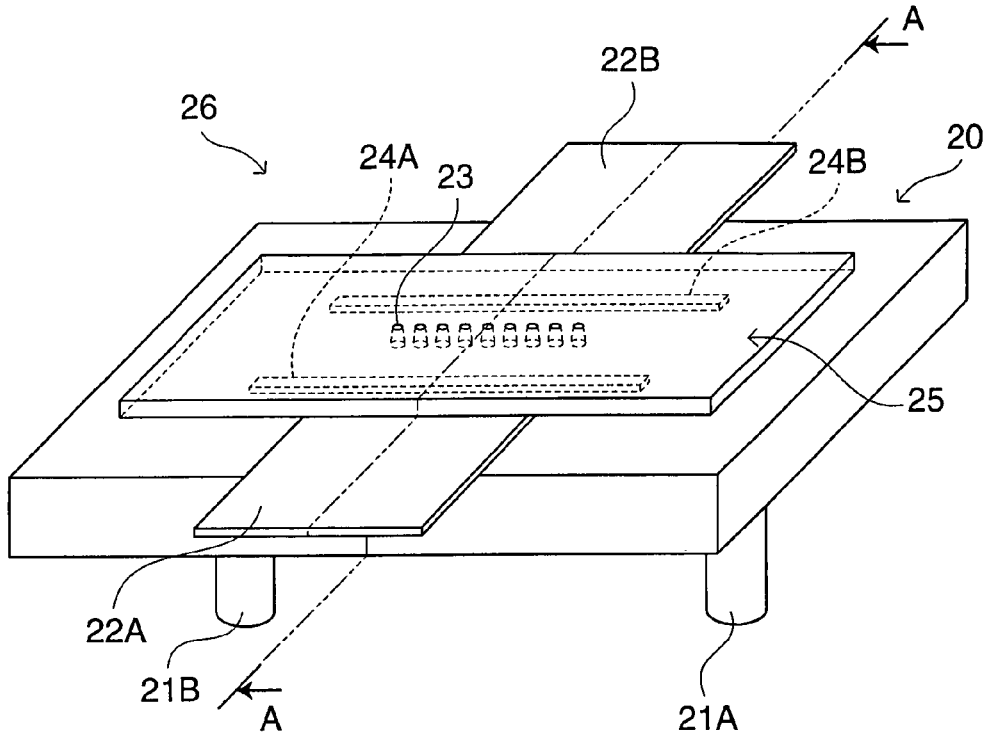
FIG. 1 is a perspective view of an ink jet head unit including an ink jet head according to an embodiment of the present invention.

1: Piezoelectric board
2: Ink jet head
4: Ink chambers
5: Shallow channel portions
6: Electrodes
7A,7B: Common ink chambers
10: Ink jet head main body
20: Base
20*a*: Head accommodating recess
21A,21B: Ink supply pipes
22A,22B: Flexible wiring boards
23: Nozzle holes
24A,24B: Recesses
25: Nozzle plate
25*a*: Base film
25*b*: Water repellent film
26: Ink jet head unit
27: Protection tape
30,31: Dicing blades
40: Nozzle hole formation mask
40*a*,50*a*,50*b*: Openings
50: Recess formation mask
A.E1,A.E2: Active areas
D: Depth of recess
L: Length of recess as measured longitudinally of ink chamber

BEST MODE FOR CARRYING OUT THE INVENTION

An ink jet head according to the present invention includes: a piezoelectric board having a plurality of elongated channels arranged parallel to each other and isolated from each other by channel walls; and a nozzle plate having a plurality of nozzle holes provided in association with the channels, and bonded onto the piezoelectric board with the nozzle holes located at generally longitudinally middle positions of the respective channels; wherein the nozzle plate has trench-like recesses each having a predetermined width and a predetermined depth and extending perpendicularly to the channels as being spaced equidistantly from the nozzle holes longitudinally of the channels; gaps for communication between adjacent channels are defined by the recesses between a surface of the nozzle plate and upper face portions of the channel walls located equidistantly from the nozzle holes; and active areas contributable to ink ejection are defined in each of the channels on opposite sides of the corresponding nozzle hole along the channel.

In the present invention, the piezoelectric board includes two piezoelectric plates having different polarization directions and bonded to each other.

The channels may be elongated grooves which are arranged parallel to each other as being isolated from each other by the channel walls and each have a predetermined width and a predetermined depth. Electrodes which respectively generate electric fields perpendicularly to the polarization directions to deform the channel walls in shearing directions when voltages are applied to interior surfaces of the respective channels according to image data are provided on interior surfaces of the respective channels.

In the inventive ink jet head, the recesses preferably each have a depth of not greater than 20 μm.

With this arrangement, the gaps defined between the upper face portions of the channel walls and the surface of the nozzle plate by the recesses each have a very small height, so that the majority of pressure waves can be more effectively attenuated when passing through the very small gaps. Therefore, residual vibration due to the pressure waves can be more effectively prevented, which may otherwise influence the subsequent ink ejection. Thus, an image can be formed as having a higher quality and a higher fidelity to the image data at a higher speed.

Even if the depth is greater than 20 μm, it is possible to provide a pressure wave attenuation effect. However, the maximum attenuation effect can be provided when the recesses each have a depth of not greater than 20 μm as will be described in the following embodiment.

In the inventive ink jet head, distances between the recesses and the nozzle holes are preferably determined based on lengths of active areas which are required for providing desired ejection characteristics.

The lengths of the active areas contributable to the ink ejection should be optimally determined in consideration of various factors such as the shapes of the ink chambers, the type of the ink and the driving frequency, and are one of the most important factors in designing the ink jet head.

In the present invention, as described above, the recesses are located equidistantly from the nozzle holes, and the lengths of the active areas are defined by the distances between the recesses and the nozzle holes. Therefore, even if the nozzle plate and the piezoelectric board are bonded to each other in offset relation in a production process, the active areas can be located on opposite sides of the nozzle holes as each having an optimum length for ensuring the desired ejection characteristics by providing the recesses in optimum positions for ensuring the desired ejection characteristics.

Thus, the ink jet head can be stably produced as having a higher quality and a higher performance.

In the inventive ink jet head, the recesses of the nozzle plate are preferably formed by an excimer laser process.

This is because it is a common practice to employ the excimer laser process for the formation of the nozzle holes in the nozzle plate.

Where the nozzle holes are formed by the excimer laser process with the use of a nozzle hole formation mask in a nozzle hole processing step and then the recesses are formed by the excimer laser process with the use of a recess formation mask, the production of the inventive ink jet head can be achieved simply by newly preparing the recess formation mask. Thus, an increase in production costs can be minimized.

Where a pulse-controlled excimer laser is employed, the recesses are formed as having the desired depth with a higher level of reproducibility by controlling the number of pulses.

In the inventive ink jet head, the nozzle plate may be composed of a polymer material.

In this arrangement, the polymer material is preferably one of a polyimide film and polyether sulfone.

This is because the polymer material such as the polyimide film or polyether sulfone absorbs the excimer laser to be decomposed into molecules or atoms with its molecular bonds cut and evaporate. Thus, the nozzle holes and the recesses can be each formed as having a shape strictly conforming to the pattern of the mask and, therefore, the polymer material is advantageous for forming the nozzle holes and the recesses with a higher level of accuracy.

As described above, the formation of the recesses can be achieved simply by preparing the recess formation mask in addition to the nozzle hole formation mask, thereby minimizing the increase in production costs.

According to another aspect of the present invention, there is provided a production method for the inventive ink jet head, comprising the steps of: forming a plurality of channels in a piezoelectric board; forming nozzle holes in a nozzle plate; forming trench-like recesses having a predetermined width and a predetermined depth in the nozzle plate, the recesses extending perpendicularly to the channels as being spaced equidistantly from the nozzle holes of the nozzle plate longitudinally of the channels; and bonding the nozzle plate to the piezoelectric board with the nozzle holes being located at generally longitudinally middle positions of the respective channels.

The present invention will hereinafter be described in detail by way of embodiment thereof illustrated in the drawings.

EMBODIMENT

An ink jet head and a production method therefor according to embodiment of the present invention will be described with reference to FIGS. 1 to 8.

Figure 2:
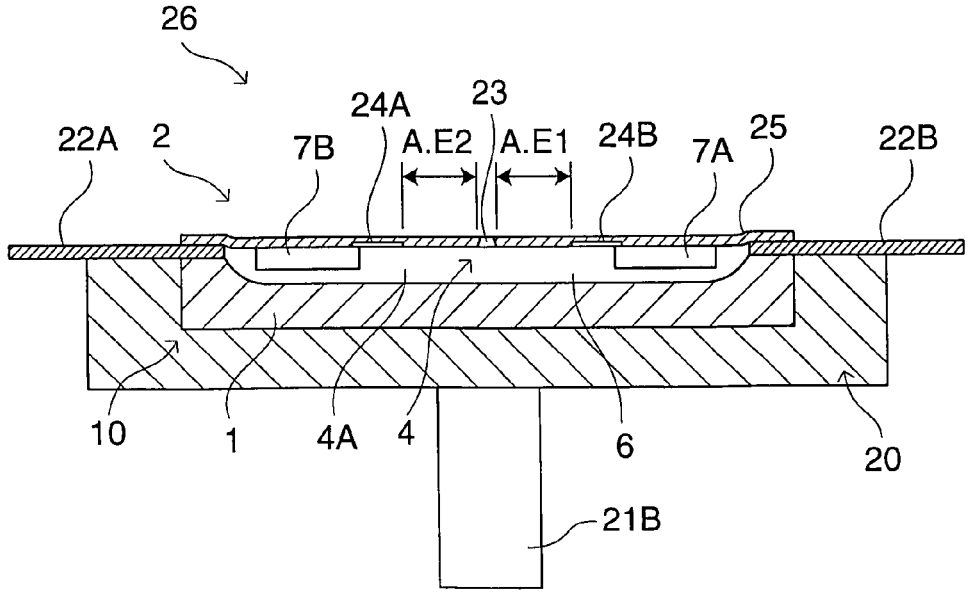
FIG. 2 is a sectional view taken along a line A-A in FIG. 1.
Figure 3A:
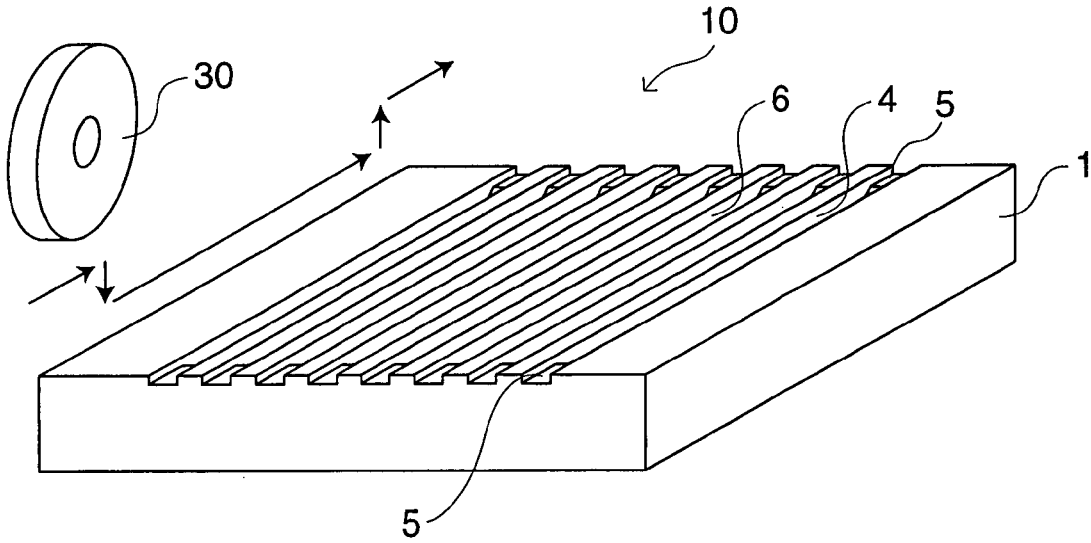
FIG. 3 is a process diagram showing a production process for an ink jet head main body.
Figure 3B:
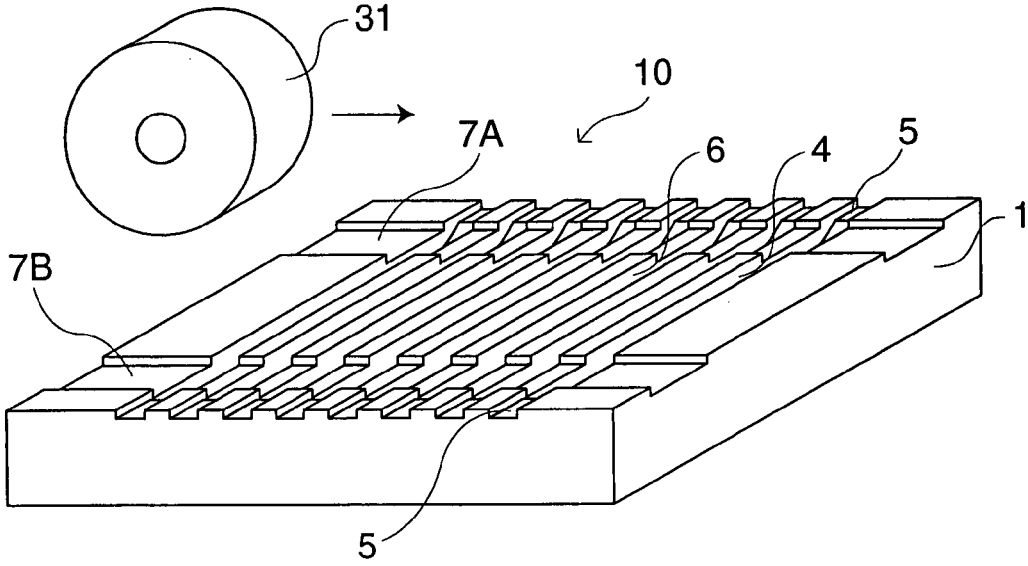
Figure 4A:
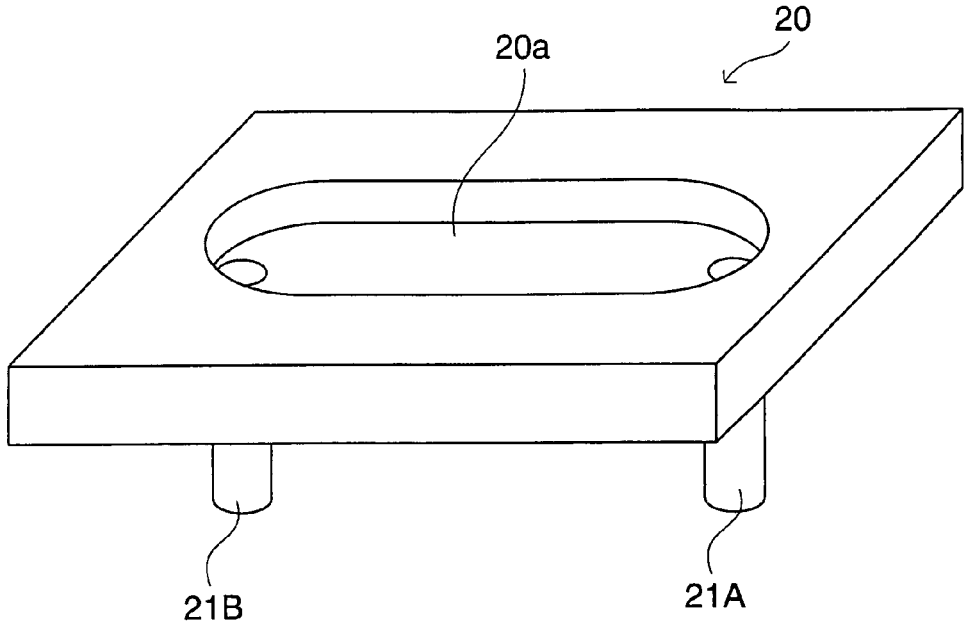
FIG. 4 is a process diagram showing a process for producing the ink jet head unit by incorporating the ink jet head main body.
Figure 4B:
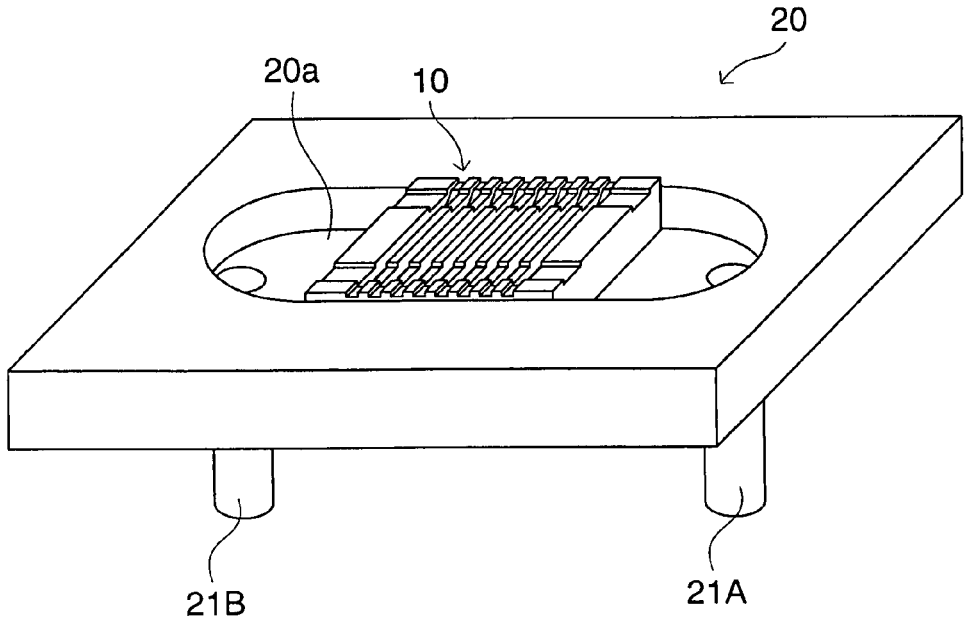
Figure 5C:
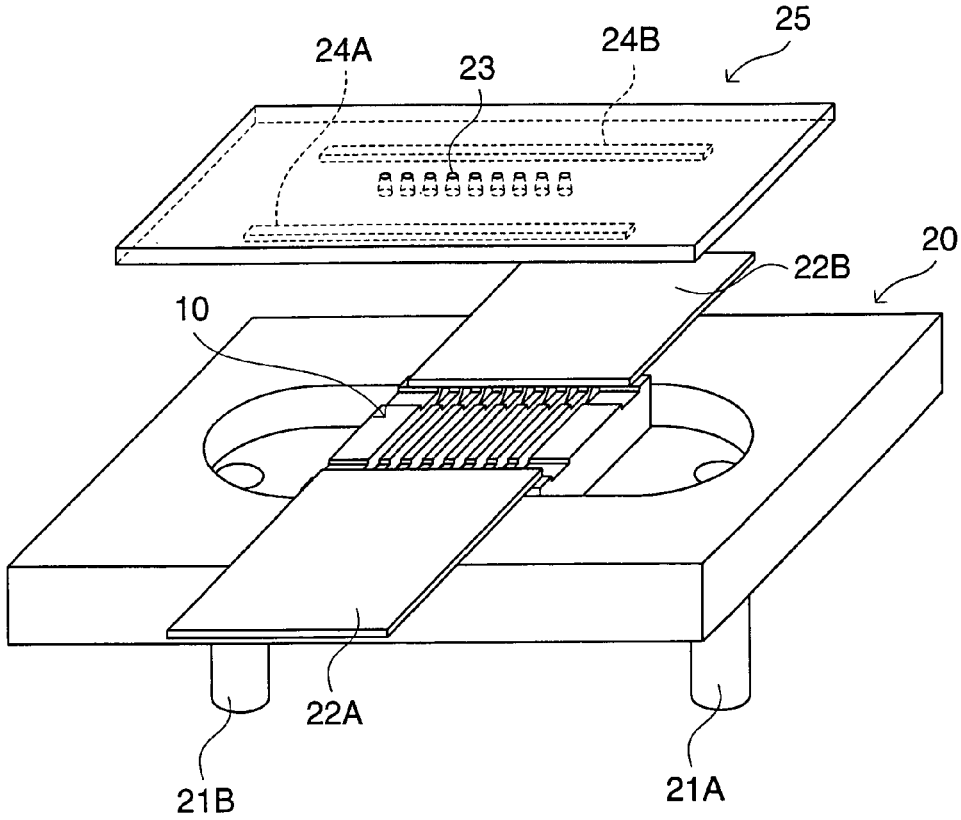
FIG. 5 is a process diagram showing the process for producing the ink jet head unit by incorporating the ink jet head main body.
Figure 5D:
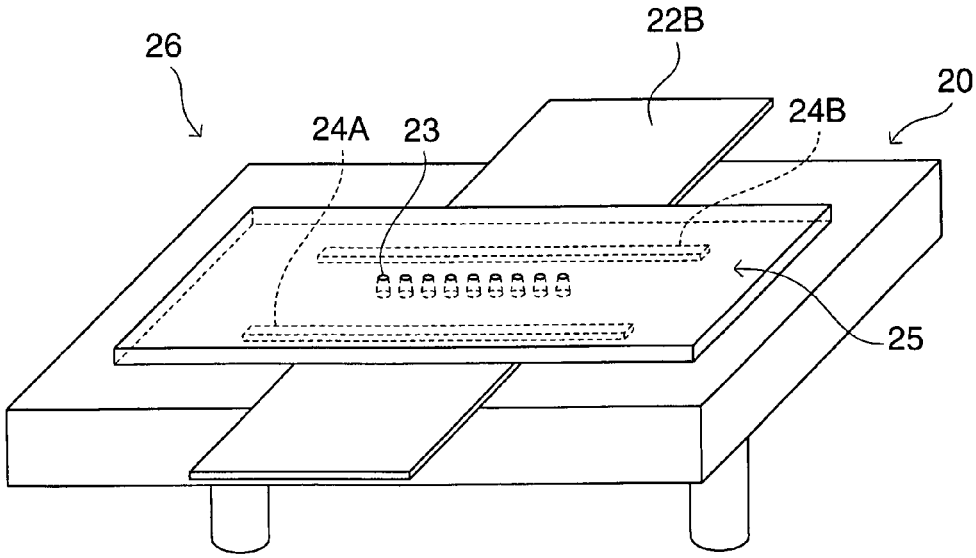
Figure 6A:
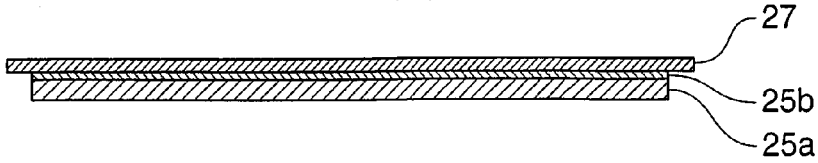
FIG. 6 is a process diagram showing a preparation process for a nozzle plate.
Figure 6B:
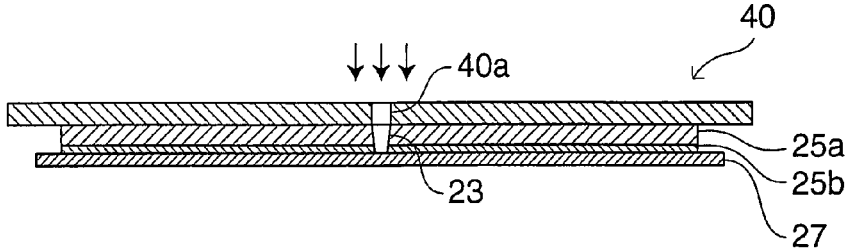
Figure 6C:
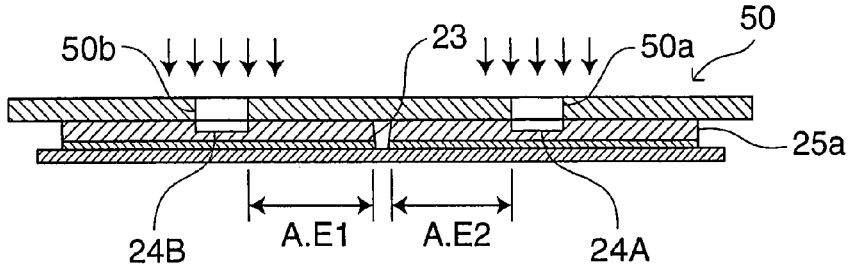
Figure 7:
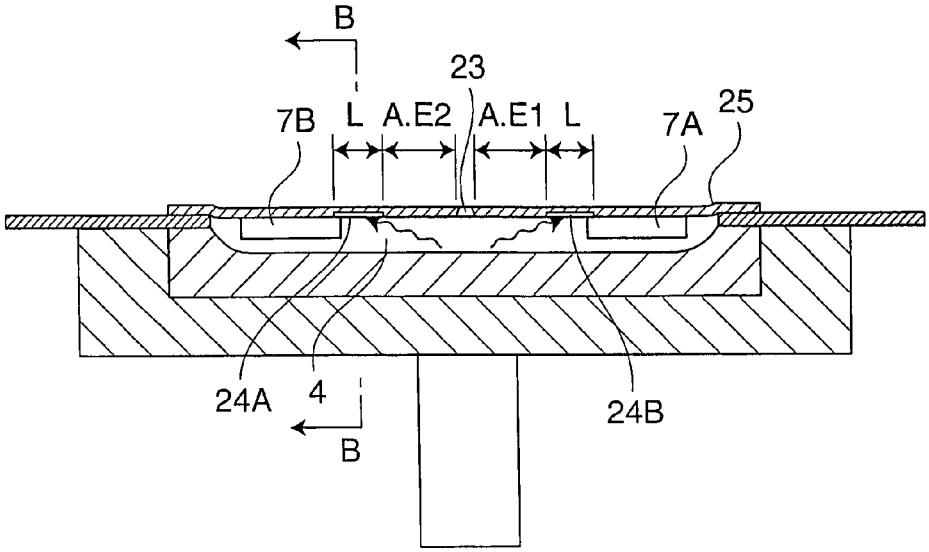
FIG. 7 is an explanatory diagram for explaining how pressure waves occurring after ink ejection are absorbed or attenuated when passing through gaps defined by recesses of the nozzle plate.
Figure 8:
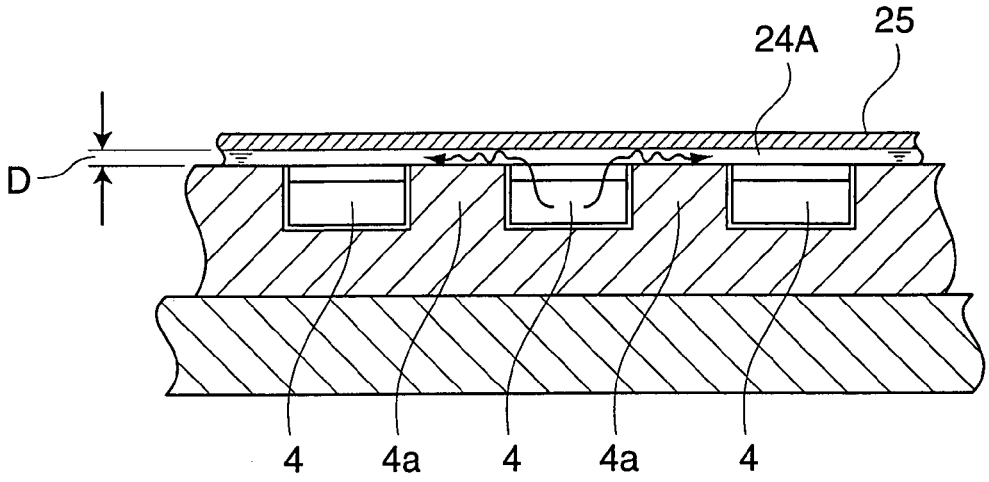
FIG. 8 is an explanatory diagram illustrating a partial section taken along a line B-B in FIG. 7 on a greater scale for explaining how the pressure waves occurring after the ink ejection are absorbed or attenuated when passing through the gaps defined by the recesses of the nozzle plate.

FIG. 1 is a perspective view of an ink jet head unit including an ink jet head according to an embodiment of the present invention, and FIG. 2 is a sectional view taken along a line A-A in FIG. 1. FIG. 3 is a process diagram showing a production process for an ink jet head main body, and FIGS. 4 and 5 are process diagrams showing a process for producing the ink jet head unit by incorporating the ink jet head main body. FIG. 6 is a process diagram showing a preparation process for a nozzle plate. FIGS. 7 and 8 are explanatory diagrams for explaining how pressure waves occurring after ink ejection are absorbed or attenuated when passing through gaps defined by recesses of the nozzle plate and, particularly, FIG. 8 illustrates a partial section taken along a line B-B in FIG. 7 on a greater scale.

As shown in FIGS. 1 and 2, an ink jet head 2 incorporated in an ink jet head unit 26 primarily includes a piezoelectric board 1 as an ink jet head main body 10 having a plurality of elongated ink chambers (channels) 4 arranged parallel to each other and isolated from each other by ink chamber walls (channel walls) 4*a*, and a nozzle plate 25 having a plurality of nozzle holes 23 provided in association with the ink chambers 4 and bonded onto the piezoelectric board 1 with the nozzle holes 23 being located at generally longitudinally middle positions of the respective ink chambers 4.

The nozzle plate 25 has trench-like recesses 24A, 24B extending perpendicularly to the ink chambers 4 as being spaced equidistantly from the nozzle holes 23 longitudinally of the ink chambers 4 and each having a predetermined width and a predetermined depth. Gaps for communication between adjacent ink chambers 4 are defined by the recesses 24A, 24B between a surface of the nozzle plate 25 and upper face portions of the ink chamber walls 4*a* located equidistantly from the nozzle holes 23, and active areas A.E1, A.E2 contributable to ink ejection are defined in each of the ink chambers 4 on opposite sides of the corresponding nozzle hole 23 along the ink chamber 4.

What should be herein noted is that the lengths of the active areas A.E1, A.E2 disposed on the opposite sides of the nozzle hole 23 are inevitably equal to each other as measured longitudinally of the ink chamber 4 even if the nozzle plate 25 is bonded to the ink jet head main body 10 in offset relation, and that the small gaps are defined by the recesses 24A, 24B between the nozzle plate 25 and the upper face portions of the ink chamber walls 4*a*, because the recesses 24A, 24B are spaced equidistantly from the nozzle holes 23.

Since the lengths of the active areas A.E1, A.E2 are inevitably equal to each other, the times required for pressure waves generated in the respective active areas A.E1, A.E2 by pressurization of ink in the ink chambers 4 to reach the nozzle holes 23 are equal to each other, thereby preventing the deterioration of the ejection characteristics.

The pressure waves generated in the ink chambers 4 are mostly absorbed or attenuated by the small gaps defined by the recesses 24A, 24B when passing through the gaps, thereby suppressing the deterioration of the ejection characteristics occurring due to residual vibration. Thus, the ejection characteristics are stably maintained even in high speed driving.

A production process for the ink jet head main body will be described in detail with reference to FIG. 3.

As shown in FIG. 3(*a*), a dicing blade 30 is moved up and down with respect to a piezoelectric board 1 as indicated by arrows to form a plurality of ink chambers 4 and shallow channel portions 5.

Round profiles present between the ink chambers 4 and the shallow channel portions 5 conform to the outer shape of the dicing blade 30.

The piezoelectric board 1 has a thickness of 1.02 mm, and is prepared by bonding two piezoelectric plates having different polarization directions and respectively having thicknesses of 0.22 mm and 0.8 mm.

The shallow channel portions 5 may be formed only on one edge of the piezoelectric board 1, but are formed on opposite edges of the piezoelectric board 1 in this embodiment.

The shallow channel portions 5 later function as external connection terminals with electrodes 6 (see FIG. 2) formed on surfaces thereof in the subsequent step. Where the shallow channel portions 5 are provided on the opposite edges of the piezoelectric board 1 as in this embodiment, a connection pitch is doubled as compared with a case in which the shallow channel portions 5 are provided only on one edge of the piezoelectric board 1. Therefore, the pitch of the ink chambers 4 as measured in a widthwise direction is not limited by a connection pitch limit of the external connection terminals.

Further, there is no need to reduce the connection pitch of the external connection terminals to the connection pitch limit, advantageously allowing for highly reliable connection with external boards.

The ink chambers 4 each have a depth of about 250 μm and a width of 80 μm, and are arranged at a pitch of 169.3 μm. This permits a nozzle density of 150 DPI.

On the other hand, the shallow channel portions 5 each have a depth of 25 μm and a width of 80 μm which equals to the width of the ink chamber 4.

The shallow channel portions 5 which later serve as the external connection terminals may be subjected to a blade process a plurality of times so as to be broadened. Thus, the reliability of the connection to the external boards is further improved. In general, the shallow channel portions 5 each having a width of 80 μm ensures sufficiently reliable connection.

Even if the pitch of the ink chambers 4 laid out according to this embodiment is reduced to less than 169.3 μm to increase the nozzle density, the reliable connection to the external boards can be ensured by providing the shallow channel portions 5 on the opposite edges of the piezoelectric board 1 for the sufficient connection pitch, and broadening the shallow channel portions 5 as described above.

After the ink chambers 4 and the shallow channel portions 5 are formed in the piezoelectric board 1 as described above, electrodes 6 (see FIG. 2) are formed on interior surfaces of the ink chambers 4 and interior surfaces of the shallow channel portions 5 by an evaporation method, a sputtering method or a plating method.

In the formation of the electrodes 6, an electrode material is also applied on surface portions of the piezoelectric board 1 other than the ink chambers 4 and the shallow channel portions 5. In this state, short-circuit may occur between the adjacent ink chambers 4. Therefore, the surface portions of the piezoelectric board 1 are ground by a thickness of 20 μm by means of a dicing machine for removal of the unwanted electrode material present on the surface portions of the piezoelectric board 1 after the formation of the electrodes 6.

As a result, the thickness of the piezoelectric board 1 is reduced from 1.02 mm to 1.0 mm, and the electrodes 6 are present only on the interior surfaces of the ink chambers 4 and the shallow channel portions 5. Thus, the shallow channel portions 5 serve as the external connection terminals for connection to the external boards.

A permissible variation in parallelism between the rear and front surfaces of the piezoelectric board 1 resulting from the grinding process is 1 μm at the maximum.

In turn, common ink chambers 7A, 7B are formed by means of a wider dicing blade 31 as shown in FIG. 3(*b*). Thus, the common ink chambers 7A, 7B are provided inward of the shallow channel portions 5 as extending perpendicularly to the ink chambers 4.

The common ink chambers 7A, 7B each have a smaller depth than the ink chambers 4, so that portions of the electrodes 6 present on the interior surfaces of the ink chambers 4 are respectively electrically connected to portions of the electrodes 6 present on the interior surfaces of the shallow channel portions 5 (see FIG. 2).

The common ink chambers 7A, 7B serve to supply ink to all the ink chambers 4. Since the common ink chambers desirably each have a lower flow path resistance to the ink, the common ink chambers 7A, 7B each have the greatest possible width.

The process described above is performed on a wafer, so that a plurality of ink jet head main bodies 10 are formed in a piezoelectric board 1 in the wafer state.

The wafer is diced by a dicing machine to provide the ink jet head main bodies 10.

Next, a process for producing an ink jet head unit 26 shown in FIGS. 1 and 2 by incorporating the ink jet head main body 10 produced by the above mentioned process will be described in detail with reference to FIGS. 4 and 5.

As shown in FIG. 4(*a*), a base 20 is first prepared. The preparation of the base 20 is achieved by counter-boring a 3-mm thick plate of aluminum, stainless steel or a ceramic material to a depth of 0.95 mm, drilling opposite end portions of a bottom of a head accommodating recess 20*a* formed by the counter-boring, and connecting ink supply pipes 21A, 21B to the resulting plate.

Then, the ink jet head main body 10 is placed in the head accommodating recess 20*a* of the base 20 as shown in FIG. 4(*b*), and an adhesive is injected into a gap defined between the head accommodating recess 20*a* and the ink jet head main body 10, whereby the ink jet head main body 10 is bonded to the head accommodating recess 20*a* and the gap between the ink jet head main body and the head accommodating recess is sealed.

Since the depth of the head accommodating recess 20*a* is 0.95 mm as described above, the 1.0-mm thick ink jet head main body 10 projects by 50 μm from the surface of the base 20.

Subsequently, flexible wiring boards 22A, 22B as the external boards are connected via an anisotropically electrically conductive resin to the shallow channel portions 5 as the external connection terminals each projecting by 45 μm from the surface of the base 20 as shown in FIG. 5(*c*).

Thus, voltages can be applied to the respective ink chambers 4 of the ink jet head main body 10 based on image data to externally drive the ink jet head.

In addition to the aforesaid connection method using the anisotropically electrically conductive resin, exemplary methods for the connection to the external boards include a method in which leads of the external boards are connected directly to the external connection terminals of the ink jet head main body 10, and a method in which the leads of the external boards are connected to the external connection terminals of the ink jet head main body 10 by wire bonding.

Connector portions of the flexible wiring boards 22A, 22B to be connected to the shallow channel portions 5 each have a thickness of about 50 μm. Therefore, the surfaces of the flexible wiring boards 22A, 22B project by about 50 μm from the surface of the ink jet head main body 10 when the connection is established in the aforesaid manner.

Even in such a state, no particular problem occurs. If the surfaces of the flexible wiring boards 22A, 22B should be flush with the surface of the ink jet head main body 10 with the flexible wiring boards 22A, 22B connected to the ink jet head main body 10, only opposite edge portions of the ink jet head main body 10 to be overlapped with the flexible wiring boards 22A, 22B may be counter-bored to a depth of 50 μm.

In this case, the shallow channel portions 5 as the external connection terminals should each have a depth of 5 μm. Therefore, the shallow channel portions 5 should be initially formed as having a depth of 75 μm, rather than a depth of 25 μm as described above, in the production process for the ink jet head main body 10.

Next, an electrode protection film (not shown) having a thickness of about 10 μm is formed for protecting the electrodes 6 formed on the interior surfaces of the ink chambers 4 of the ink jet head main body 10.

In the formation of the electrode protection film, an electrode protection film material adheres everywhere on the surface of the ink jet head main body 10, the flexible wiring boards 22A, 22B, the base 20 and the ink supply pipes 21A, 21B. Therefore, the flexible wiring boards 22A, 22B which need not be covered with the electrode protection film is masked with a masking tape for prevention of the adhesion of the electrode protection film material prior to the formation of the electrode protection film.

In turn, a nozzle plate 25 formed with nozzle holes 23 and recesses 24A, 24B is bonded onto the surface of the ink jet head main body 10.

The nozzle plate 25 has a greater outer size than the ink jet head main body 10 (see FIG. 5(*c*)), and is bonded so as to cover the head accommodating recess 20*a* of the base 20 (see FIG. 4(*b*)).

After the nozzle plate 25 is bonded to the ink jet head main body 10, an adhesive is injected into gaps between the nozzle plate 25 and the base 20 and between the nozzle plate 25 and the flexible wiring boards 22A, 22B to externally seal the ink jet head main body 10.

Thus, the ink jet head unit 26 shown in FIGS. 1 and 2 is produced.

A preparation method for the aforesaid nozzle plate 25 will be described in detail with reference to FIG. 6 {FIGS. 6(*a*) to 6(*c*)}.

As shown in FIG. 6(*a*), a water repellent film 25*b* which is repellent to the ink is formed on an ink ejection side of a base film 25*a* of a polymer material such as a polyimide film or polyether sulfone, and a protection tape 27 is applied onto the water repellent film for protection of the water repellent film.

Then, the resulting film is irradiated with a pulse-controlled excimer laser with the use of a nozzle hole formation mask 40 having openings 40*a* located at positions corresponding to the positions of the nozzle holes 23 (see FIG. 1) as shown in FIG. 6(*b*).

At this time, the excimer laser passes through the base film 25*a* and the water repellent film 25*b* to reach parts of the protection tape 27, whereby the polymer material of the base film 25*a* is partly decomposed into molecules or atoms with its molecular bonds cut to evaporate. Thus, the nozzle holes 23 are formed as extending through the base film 25*a* and the water repellent film 25*b* at the positions of the openings 40*a* of the nozzle hole formation mask 40.

Subsequently, the resulting film is irradiated with a pulse-controlled excimer laser with the use of a recess formation mask 50 having openings 50*a*, 50*b* located at positions corresponding to the positions of the recesses 24A, 24B as shown in FIG. 6(*c*).

At this time, the polymer material of the base film 25*a* is partly decomposed into molecules or atoms with its molecular bonds cut to evaporate as in the formation of the nozzle holes 23, whereby the recesses 24A, 24B are formed as each having a predetermined depth. The formation of the recesses 24A, 24B each having the predetermined depth is achieved by controlling the pulse number of the excimer laser to be applied.

Variations in the distances between the nozzle holes 23 and the recesses 24A, 24B, i.e., variations in the lengths of A.E1 and A.E2, are determined by the positional accuracy of the recess formation mask 50 with respect to the nozzle holes 23 in the laser irradiation. If necessary, correction of the laser processing positions may be made with the use of a dummy nozzle plate. Therefore, the variations can be easily suppressed to less than 5 μm.

If the variations in the distances between the nozzle holes 23 and the recesses 24A, 24B, i.e., the lengths of A.E1 and A.E2, are less than 5 μm, the variations will not influence the ejection characteristics of the ink jet head unit 26.

Thus, the nozzle plate 25 is prepared. A feature of the aforesaid preparation method for the nozzle plate 25 is that the recesses 24A, 24B each having the predetermined depth can be formed at positions spaced equidistantly from the nozzle holes 23 simply by additionally performing the excimer laser process with the use of the recess formation mask 50 in the prior-art nozzle plate production process.

The excimer laser process is conventionally employed for the formation of the nozzle holes 23. Therefore, the preparation of the nozzle plate 25 according to this embodiment can be achieved simply by newly preparing the recess formation mask 50, so that existing equipment can be used as it is. Accordingly, an increase in production costs can be minimized.

Even if the nozzle plate 25 is bonded to the ink jet head main body 10 in offset relation, the times required for pressure waves occurring in the respective active areas A.E1, A.E2 to reach the nozzle holes 23 are equal to each other, thereby preventing deterioration of the ejection characteristics. Further, the pressure waves are mostly attenuated by the small gaps defined by the recesses 24A, 24B to suppress residual vibration, whereby the ejection characteristics can be stably maintained even in high speed driving as described above. The nozzle plate 25 which provides these effects can be prepared by the aforesaid simple method with a minimum increase in production costs as described above.

As a result, the ink jet head 26 can be stably produced as having a higher quality and a higher performance without an increase in production costs.

The pressure wave absorption/attenuation effect observed when the pressure waves pass through the gaps will be explained with reference to FIGS. 7 and 8. FIG. 8 is an enlarged partial sectional view taken along a line B-B in FIG. 7.

As shown in FIG. 7, pressure waves generated in the active areas A.E1, A.E2 within the ink chambers 4 when the interior surfaces of the ink chambers 4 are deformed inward by application of voltages to eject the ink from the nozzle holes 23 travel toward the recesses 24A, 24B and the common ink chambers 7A, 7B in directions opposite to ink supply paths as indicated by arrows. When the pressure waves reach the recesses 24A, 24B, the pressure waves are partly reflected on the interior surfaces of the recesses 24A, 24B back into the ink chambers 4, but the pressure waves mostly pass through the gaps defined by the recesses 24A, 24B.

As shown in FIG. 8, the pressure waves are mostly absorbed by the viscosity of the ink when passing through the small gaps defined by the recess 24A between the nozzle plate 25 and the ink chamber walls 4*a*, or repeatedly reflected on the interior surface of the recess 24A to be attenuated, and then reach the adjacent ink chambers 4 or the common ink chambers 7A, 7B (see FIG. 7). Though the recess 24B is not shown in FIG. 8, the same absorption/attenuation effect occurs in the recess 24B.

Figure 9:
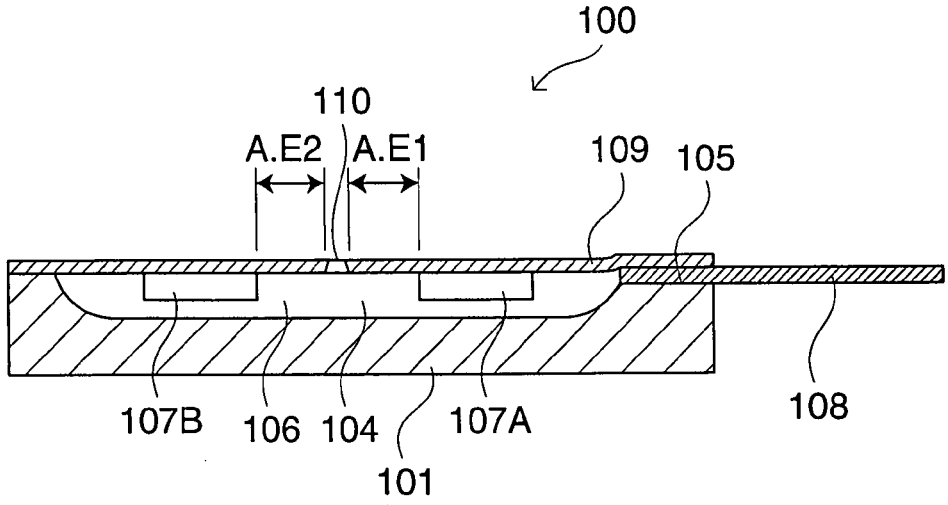
FIG. 9 is an explanatory diagram illustrating the construction of a prior-art ink jet head unit.

Therefore, the pressure waves are not reflected on the interior surfaces of the common ink chambers 107A, 107B back into the ink chambers 104 as in the prior-art ink jet head 100 shown in FIG. 9, but are mostly absorbed or attenuated when passing through the gaps defined by the recesses 24A, 24B, thereby suppressing the residual vibration.

The pressure wave absorption/attenuation effect is significantly influenced by the heights of the gaps, i.e., the depths D of the recesses 24A, 24B of the nozzle plate 25 (see FIG. 8). Therefore, the depths of the recesses 24A, 24B should be optimally determined to provide a preferred absorption/attenuation property.

To this end, an experiment was performed with the use of the ink jet head unit 100 having the prior-art structure shown in FIG. 9 and ink jet heads 26 including recesses 24A, 24B having four different depths according to the embodiment of the present invention to evaluate the ejection characteristics of the respective ink jet units and check if residual vibration occurs due to pressure waves. The results are shown in the following Table 1.

TABLE 1

| | Active areas | Lengths L of recesses | Depths D of recesses | Residual vibration |
|---|---|---|---|---|
| Prior-art structure | 1.15 mm | — | — | X |
| Comparative Example 1 | 1.15 mm | 1.35 mm | 0.01 mm | ◎ |
| Comparative Example 2 | 1.15 mm | 1.35 mm | 0.02 mm | ○ |
| Comparative Example 3 | 1.15 mm | 1.35 mm | 0.03 mm | Δ |
| Comparative Example 4 | 1.15 mm | 1.35 mm | 0.04 mm | X |

As apparent from the results of the experiment shown in Table 1, the influence of the residual vibration tends to diminish, as the heights of the gaps or the depths of the recesses 24A, 24B of the nozzle plate 25 are reduced. Further, it was found that, where the recesses 24A, 24B each have a depth of 40 μm, a pressure wave component reflected on the interior surfaces of the recesses 24A, 24B back into the ink chambers 4 is increased as in the prior-art ink jet head 100 shown in FIG. 9, thereby adversely influencing the ink ejection characteristics.

Though not apparent from Table 1, it was confirmed that, where the lengths L of the recesses 24A, 24B as measured longitudinally of the ink chambers 4 (see FIG. 7) are each set to the greatest possible level, the effect of suppressing the residual vibration occurring due to the pressure waves is enhanced.

In the ink jet unit 26 according to this embodiment, the small gaps are formed between the active areas A.E1, A.E2 and the common ink chambers 7A, 7B by the provision of the recesses 24A, 24B in the nozzle plate 25. Therefore, the pressure waves generated in the ink chambers 4 can be speedily attenuated when passing through the gaps.

As a result, the influence of the residual vibration is minimized, so that the subsequent ink ejection smoothly occurs. Thus, an image having a higher quality and a higher fidelity to image data can be formed at a higher speed.

The invention claimed is:

1. An ink jet head comprising:

a piezoelectric board having a plurality of elongated channels arranged parallel to each other and isolated from each other by channel walls; and a nozzle plate having a plurality of nozzle holes provided in association with the channels, and bonded onto the piezoelectric board with the nozzle holes located at generally longitudinally middle positions of the respective channels;

wherein the nozzle plate has trench-like recesses each having a predetermined width and a predetermined depth and extending perpendicularly to the channels as being spaced equidistantly from the nozzle holes longitudinally of the channels;

gaps for communication between adjacent channels are defined by the recesses between a surface of the nozzle plate and upper face portions of the channel walls located equidistantly from the nozzle holes; and active areas contributable to ink ejection are defined in each of the channels on opposite sides of the corresponding nozzle hole along the channel.

2. An ink jet head as set forth in claim 1, wherein the recesses each have a depth of not greater than 20 μm.

3. An ink jet head as set forth in claim 1, wherein distances between the recesses and the nozzle holes are determined based on lengths of active areas which are required for ensuring desired ejection characteristics.

4. An ink jet head as set forth in claim 1, wherein the recesses of the nozzle plate are formed by an excimer laser process.

5. An ink jet head as set forth in claim 1, wherein the nozzle plate is composed of a polymer material.

6. An ink jet head as set forth in claim 5, wherein the polymer material is one of a polyimide film and polyether sulfone.

7. A production method for an ink jet head as recited in claim 1, the method comprising the steps of:

forming a plurality of channels in a piezoelectric board;

forming nozzle holes in a nozzle plate;

forming trench-like recesses having a predetermined width and a predetermined depth in the nozzle plate, the recesses extending perpendicularly to the channels as being spaced equidistantly from the nozzle holes longitudinally of the channels; and bonding the nozzle plate to the piezoelectric board with the nozzle holes located at generally longitudinally middle positions of the respective channels.

* * * * *